United States Patent [19]

Plank et al.

[11] Patent Number: 4,878,623

[45] Date of Patent: Nov. 7, 1989

[54] PROCESS AND DEVICE FOR MECHANICALLY REMOVING THE SURFACE OF LUMPED GOODS

[75] Inventors: Friedrich W. Plank; Helmut Machnig; Georg H. Mischke, all of Menden; Reinhard Friedrichs; Norbert Nahrmann, both of Oelde, all of Fed. Rep. of Germany

[73] Assignee: Rheinisch-Westfalische Kalwerke AG, Fed. Rep. of Germany

[21] Appl. No.: 192,513

[22] PCT Filed: Dec. 21, 1985

[86] PCT No.: PCT/DE85/00553

§ 371 Date: Feb. 19, 1988

§ 102(e) Date: Feb. 19, 1988

[87] PCT Pub. No.: WO87/03826

PCT Pub. Date: Jul. 2, 1987

[51] Int. Cl.[4] ..... B07C 19/12

[52] U.S. Cl. ..... 241/5; 241/14; 241/15; 241/40; 241/81; 241/DIG. 30

[58] Field of Search ..... 241/DIG. 30, 81, 24, 241/40, 5, 15, 94, 283, 14; 51/163.1, 163.2, 313, 314

[56] References Cited

U.S. PATENT DOCUMENTS

| | | | |
|---|---|---|---|
| 3,682,397 | 8/1972 | Bodine . | |
| 3,827,186 | 8/1974 | Ehnot | 51/314 X |

FOREIGN PATENT DOCUMENTS

| | | | |
|---|---|---|---|
| 401027 | 8/1924 | Fed. Rep. of Germany . | |
| 87456 | 7/1896 | Fed. Rep. of Germany . | |
| 897508 | 11/1953 | Fed. Rep. of Germany . | |
| 942551 | 7/1957 | Fed. Rep. of Germany . | |
| 1092367 | 11/1960 | Fed. Rep. of Germany . | |
| 3012866 | 10/1981 | Fed. Rep. of Germany . | |
| 2186340 | 1/1974 | France . | |
| 158597 | 12/1975 | Japan | 241/5 |

*Primary Examiner*—Mark Rosenbaum

*Attorney, Agent, or Firm*—John F. A. Earley; John F. A. Earley, III; P. Michael Walker

[57] ABSTRACT

A process and an apparatus for mechanically removing a sulphur containing layer from lumped lime, wherein the lumped lime is accelerated from a bottom member by a mechanical impulse and projected from the bottom member against a processing surface having profiles provided over partial sections thereof to remove the sulphur containing layer, when the lumped lime returns to the bottom member and the process is repeated along a conveying path for the lumped lime for a determined length of time, or for as long as it takes to achieve the desired removal of the sulphur containing layer.

40 Claims, 2 Drawing Sheets

PROCESS AND DEVICE FOR MECHANICALLY REMOVING THE SURFACE OF LUMPED GOODS

Figure 1A:
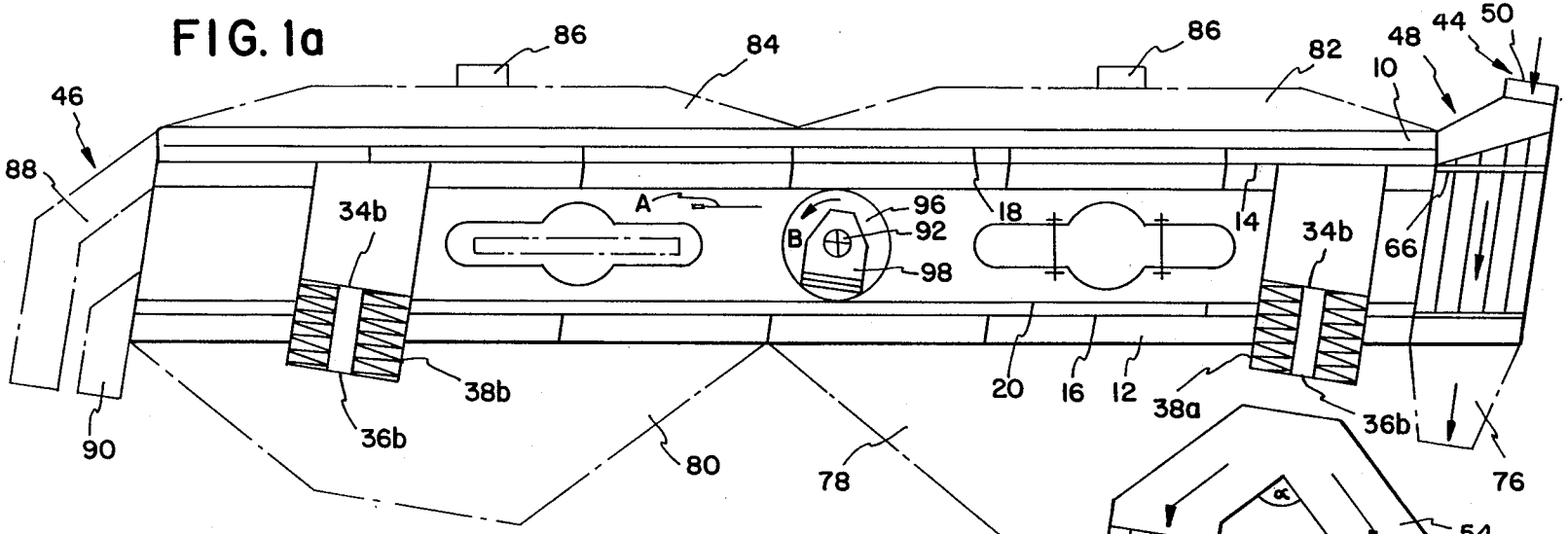

The invention relates to a process and device for mechanically removing the surfaces of lumped goods.

The surface of lumped goods has to be mechanically processed in a very wide variety of sectors of technology. It is partly a matter of removing a shell or a skin, either wholly or in part. This skin or shell may have the same material composition as the "core" of the piece, but it may also be a completely converse matter of removing an existing surface from another material.

An example in this context might be the peeling of fruit or cleaning of potatoes.

"Removal of the surfaces of lumped goods" also covers the removal of surfaces which do not form an independent constituent as such but for example display a chemical or mineral composition different from the remaining material (the core). An example of this area of application is the surface of a lumped lime produced from sulphurous fuels.

Large amounts of energy are required to execute the pyroprocess for producing lime. Basically very wide variety of energy carriers such as coal, coke and/or natural gas or petroleum are involved. Besides having a high thermal value natural gas is particularly noted for the fact that it is almost free of sulphur. Fuels such as coke or brown coal products (brown coal dust) on the other hand are highly sulphurous, which means for example that lime products resulting from the firing of brown coal have a sulphur content higher by the factor two to three than those produced from the firing of natural gas.

More extensive tests have shown that the sulphur load of the burnt lime product is extremely high particularly in the area of the surface, and is reduced considerably as the layer depth increases.

For use in the steel works sector, lumped limes with an S03 content less than 0.1% by weight and frequently less than 0.05% by weight are required. Concentrations of this kind cannot be achieved with solid sulphur fuels without appropriate (mechanical) after-treatment. A reduction in the sulphur content of the fuel is technically possible but too costly.

It is normally sufficient, with the concentration gradient over the core cross-section described above, to remove only a relatively thin surface layer. The major problem however is that the lumped lime is not in spherical or other symmetrical form, in particular with a smooth surface, but in a very wide variety of configurations, so that certain surface areas (particularly at the rear) are accessible only with difficulty.

An (unpublished) proposal is known for achieving "mechanical desulphurisation" by treating the goods in a cylindrical sieve, possibly provided with fittings which have an abrasive action. However a device of this kind has considerable disadvantages including the fact that, on the one a high degree of autogenous milling is caused, which leads to an undesirable production of broken surfaces (the steel industry requires lime of a specific grain spectrum).

Further, considerable amounts of solids have to be removed in order, for example to free the granular areas which are not immediately accessible as a result of depressions or dents, slits or pocket pores created by the increased areas alongside from the surface zones of high sulphur content. With particularly irregular goods, which are actually the norm in lime production, this can mean that up to 50% by weight or more has to be removed.

On the other hand, on grounds of cost etc. the use of the said sulphurous fuels has to be made possible.

Another (also unpublished) proposal provides for mechanical processing of the granular surfaces by means of sandblasting. With a tonnage product such as lime, which is also partially of relatively small lump size (steel works lime is generally of an order of magnitude between 10 and 60 mm) a process of this kind cannot be executed, and even surface treatment is problematical.

The object of the invention is to set out a possibility for processing lumped goods mechanically, to allow material to be removed as evenly as possible over the entire surface. The object is therefore—regardless of the shape of the lumps and their geometrical surface structure—to remove as even a layer as possible over the surface, or to put it differently : a means is to be set out whereby even removal of material over the entire surface of the piece can be achieved with minimum loss of material. The invention should also offer the possibility of use in industrial production.

In particular a straightforward and reliable application is sought for bulk goods also. There is also a requirement for a proposed solution which can be adjusted on the same principle to the product for processing, and thus is adaptable to the relevant application.

The surface treatment of lumped lime is of primary interest. The invention acknowledges that—regardless of the surface structure—even removal can be achieved in that the lumped goods for processing are projected back and forth by means of a specific kinetic energy along an adjustable conveying path and/ or for a determined length of time between a bottom and a processing surface located at a distance from it.

Accordingly the invention proposes a process for mechanically removing the surfaces of lumped goods, wherein the lumped goods are projected from a bottom against a processing surface, whence they return to the bottom and the process is repeated along a conveying path for the lumped goods and/or for a determined length of time, for as long as it takes to achieve the desired surface removal, whereby the material is accelerated by means of a mechanical impulse.

Accordingly a device is proposed which displays at least a bottom to hold the goods, and a processing surface located at a distance from it, and an arrangement for applying a mechanical impulse to the goods for processing.

This arrangement may be provided in a variety of ways. In an initial, simple embodiment, a pulsatingly mobile ram is conducted in a specific cadence against the bottom, and thus applies an impulse to the goods conveyed over it. An advantageous embodiment of the invention provides for the arrangement of a forced agitator on the bottom and or the processing surface. The arrangement may however be provided so as to act via appropriate intermediate elements. A further embodiment of the invention provides for joining the bottom and the processing surface together via rigid connecting elements to create a type of processing area, and for attaching the forced agitator to one of the connecting elements. The forced agitator can be a vibrator, preferably an electrical vibrator.

In a particularly advantageous embodiment the invention provides for the forced agitator to be created by an unbalanced arrangement, mounted on and fixed to a rotatably driven shaft. A rotating or involute movement track can be achieved for the bottom, the processing surface and the goods to be processed in this way. Thus at regular or irregular intervals (for example depending on the design of the flywheel, the revolutions of the driving member and the design of bottom and processing surface) an impulse may be applied to the lumped goods resting on the bottom which is then accelerated in the direction of the processing surface, and collides with it before falling back to the bottom surface generally at a different angle.

Preferably the material is conducted against a processing surface provided with profiles at least over partial sections. Here the surface structure of the processing surface plays an important part in relation to the quality and quantity of what is removed from the surface. Even if on principle a closed, flat surface is conceivable for specific areas of application, in preferred variants specific geometrical shapes are proposed.

Profiles may for example be conical, pin-shaped, spherical, hemispherical, quarter-spherical, undulating, toothed or pyramidic. However the corresponding surface can also for example be shaped like a brush. The invention further provides for developing individual sections of the processing surface with varying profiles. Any such arrangement should be selected according to the goods for processing.

The "surface tools", in particular the projecting sections, have the effect that—as soon as the goods are hurled against them, not only projecting edges and corners are broken off or smooth surfaces abraded or brushed away, but in particular rebounding parts of the surface can also be removed, if for instance a pyramidic projection enters the area of a depression on the surface.

The optimum in even removal of the surface is achieved in particular if the piece for processing is conducted along the conveying path and/or for a determined length of time in as many different directions as possible from the bottom against the processing surface, and there if possible encounters different sections of the processing surface.

This target can be achieved in a particularly preferred embodiment of the invention, in that the goods are conducted over a deformable bottom and/or against a deformable processing surface, whereby the ductility is preferably achieved by an elastic material in the bottom and/or the processing surface.

Not only are the lumped goods hurled back and forth because of their possibly irregular surface and/or the angle of the treatment line created by the bottom and the processing surface under varying angles of incidence and angles of reflection between the bottom and the processing surface; the effect is even more heavily influenced by the elastic surfaces, their geometrical alignment and also by the forced agitation. Like a trampoline the parts are then taken up and hurled away, intensified by the additional impulse applied by the forced agitator. Counter-vibrations are built up at variable frequency distribution.

Preferably the process is executed so that the acceleration of the goods when they reach the processing surface is a multiple of the acceleration due to gravity, preferably 3 to 6 times as much.

Optimum surface removal can be achieved by developing the bottom with profiles, similarly to the processing surface, so that it also operates as an "active surface".

In the context of even and effective removal of the surface with the minimum possible loss of material, it has proved to be advantageous to operate with "constant flow". Here the direction of the movement of the goods is the same as the direction of the impulse applied. A type of rolling effect is created in this way.

With regard to the arrangement of the bottom and the processing surface, an advantageous embodiment of the invention proposes selecting the distance between both as a function of the size of the lumped goods conducted through, whereby a distance of less than twice the largest lump diameter has proved particularly advantageous. Within this range, a distance of 20 to 40% more than the largest diameter is preferred. The effect of the corresponding processing surfaces is then particularly strong. Where the impulse frequency and amplitude are adjustable, a multiplicity of contacts can be achieved over relatively short processing distances and/or lengths of time, whereby a corresponding surface layer is removed not only more rapidly, but also, as described in detail above—more evenly.

The invention thus proposes a completely new type of mechanical surface removal, and in particular completely new kinetics of the goods to be processed. Thus along with particular geometrical developments of the processing surface(s), it is possible also to remove surface areas which have not been accessible with known processes to date, in particular recoiling surface parts. In addition the forced agitators described require relatively little electrical energy to produce strong mechanical impulses and high efficiency. It is also possible for instance, by altering the configuration of bottom and/or processing surface, to make changes quite easily, in the context of varying stresses on the goods, in the impulse intensity, and direction, the distance and alignment of bottom and processing surfaces, their inclination, movement in relation to one another and/or material composition, whereby one and the same device can be adjusted to a very wide variety of lumped goods for processing.

A further optimum version of the process according to the invention or the device according to the invention can be achieved in particular by taking into account the given expedient of arranging the distance between bottom and processing surface in a particular way by dividing the loaded stream of material into different granular fractions, and conducting each through its own device whereby according to an advantageous embodiment of the invention the corresponding plant is so designed that division into different granular sizes is made by screening via a common infeed area, and the stream of material with the finer content, that falls through and down, is conducted to a device which is located beneath but essentially parallel to the first device for the coarser fractions. The plant is particularly compact. A forced agitator can thus act on both devices or their parts together, in that the processing lines are for example connected together via a system of fixed mechanical rods and mounted on a shared spring bearing.

Preferably the individual device or complete plant is in a dust- and silenceproof casing and is kept free of dust by connecting a suction appliance as provided for in a further advantageous embodiment of the invention.

The device according to the invention, possibly in combination with further devices, is particularly suitable for the mechanical desulphurisation of lumped lime (steel works lime) since, partly as a result of the irregular surface structure of lumped lime the advantages according to the invention are particularly clearly evident. The mode of operation of the process according to the invention can be further improved for an application of this kind by spraying a damp mist (water mist) onto the material in the infeed area, causing hydration of the surface, which makes the material somewhat softer and therefore easier to abrade. Naturally this advantage applies to the processing of all hydratable substances.

It has emerged that the energy with which the particles collide with the processing surface(s) is crucial to the removal of the surface. It has been found that more of the surface of large granules is removed than with small granules, at the same throughput time. For this reason an advantageous embodiment of the invention proposes dividing the stream of material for processing into component streams of varying granular fractions as already explained above, but also conveying it according to the surface removal desired, for example via treatment lines at varying gradients, so that—regardless of the granular size—a layer of equal thickness is always removed.

On account of the completely new type of processing, the mechanically desulphurised material also differs in its outer aspect from the material passed through a cylindrical sieve. Accordingly the invention also comprises lumped goods, in particular lumped lime, which is manufactured by the process according to the invention and/or using the device according to the invention. A product of this kind displays a particularly even surface.

Mechanical desulphurisation according to the invention is not only particularly effective but the process and the device are also particularly easy to operate and make it possible to process the goods quickly and effectively.

This applies not only to the lumped lime referred to above but also to the further areas of application referred to at the outset.

Further features of the invention will emerge from the remaining claims and further descriptive documents.

The invention is described in greater detail below with the help of an embodiment thereof. This shows a plant for mechanical processing of the surface of lumped lime for use in the steel works sector, where only grades of lime with a particularly low sulphur content can be used. The plant is therefore used for the mechanical desulphurisation of the lumped lime in the surface area. The drawing shows in diagram in FIG. 1*a*: a longitudinal section through a plant according to the invention for mechanical processing of the surface of lumped lime.

Figure 1B:
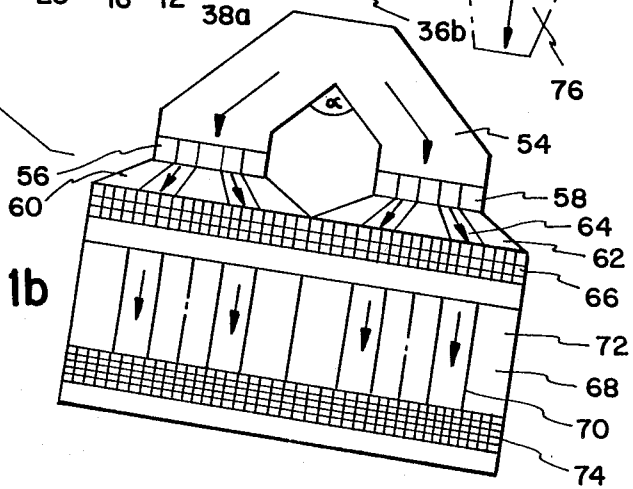

FIG. 1*b*: an enlarged representation of the infeed area of the plant according to FIG. 1*a*.

Figure 2:
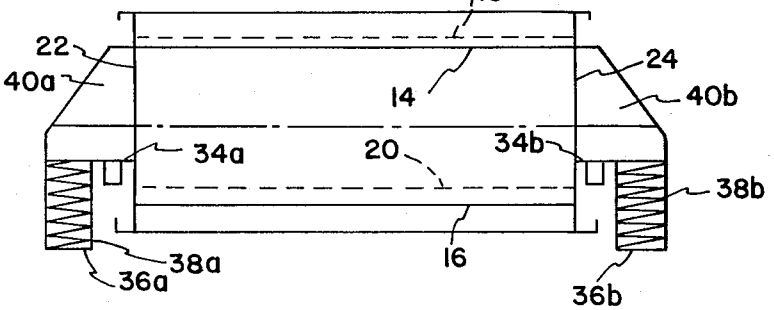

FIG. 2: a cross-section through the plant according to FIG. 1.

Figure 3:
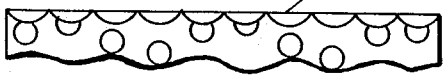

FIG. 3: an enlarged section of the processing surface of the plant according to FIGS. 1, 2, seen against the direction of conveying.

Figure 4:
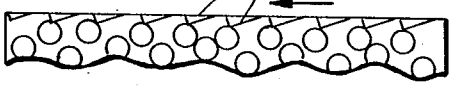

FIG. 4: an enlarged section of the processing surface, vertically to the direction of conveying.

Figure 5:
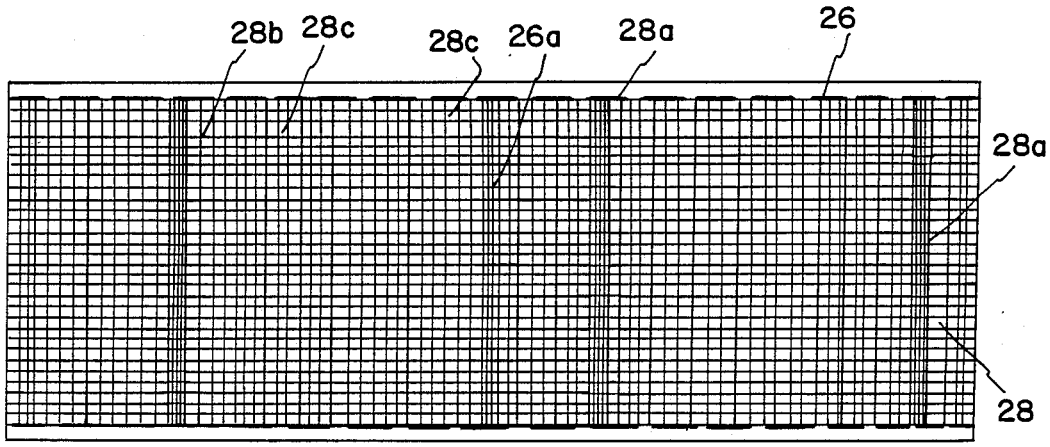

FIG. 5: a top view of the bottom of a processing line of the plant according to FIG. 1*a*.

Figure 6:
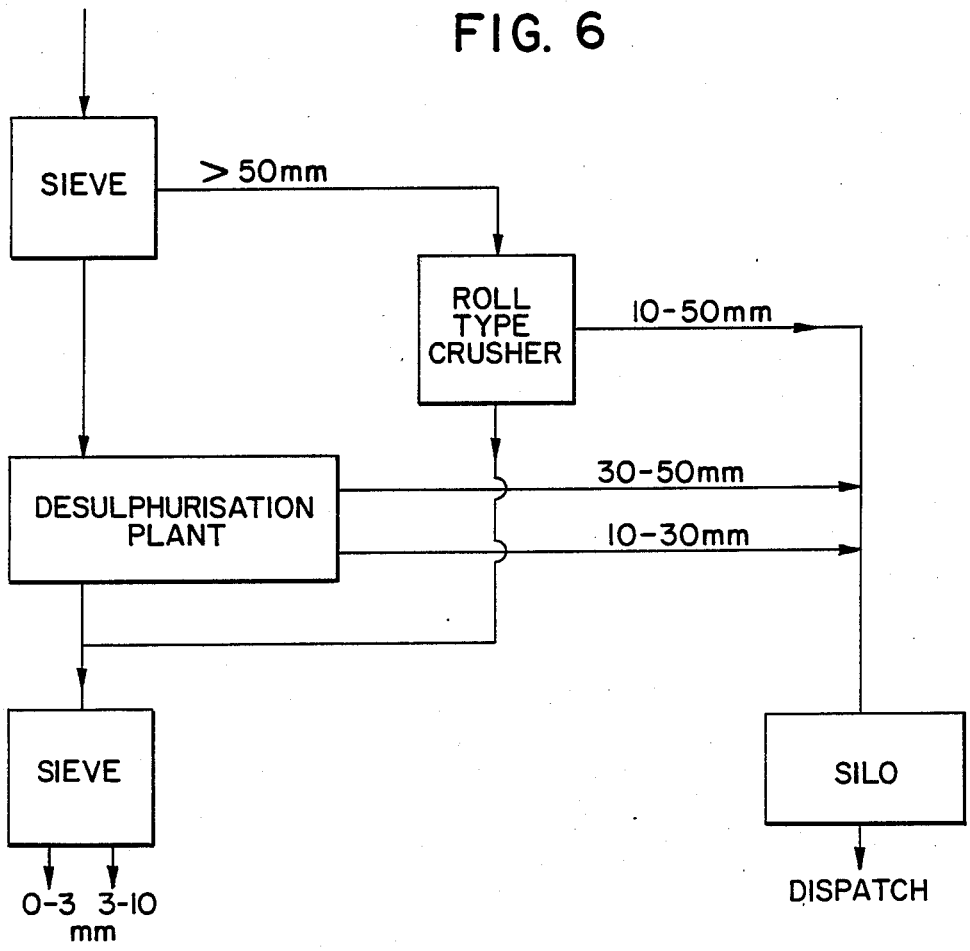

FIG. 6: a flow sheet showing the individual steps in the processing of lumped lime according to a preferred embodiment.

The plant according to FIGS. 1 to 5 comprises two processing lines 10,12, located at a distance from one another. Each of the processing lines displays a bottom, 14 or 16. Over each bottom and parallel to it so-called processing surfaces 18, 20 are arranged.

The bottoms 14, 16 and the processing surfaces 18, 20 display in top view the shape of extended rectangles, and are connected rigidly together and mutually by means of side walls 22, 24 at their opposing longitudinal edges.

Each bottom 14, 16 consists of a surrounding metal frame 26, the longitudinal sides whereof are connected at a distance from one another via diagonal members **26*a*. On the metal frame 26, or the diagonal members 26*a*, a rubber blanket is tentered or attached, for example via a tentering device (not shown) in the frame area or appropriate screw connections. The rubber blanket displays over its surface in the longitudinal section and vertically thereto closed strips 28*a* extending at a distance from one another, which enclose rectangular areas 28*b*. The areas 28*b* are provided with a multiplicity of through holes 28*c***.

The rubber blanket can for example be made of hard rubber material.

The processing surfaces 18,20 each consist of a metal sheet, preferably a steel sheet. The steel sheet displays a multiplicity of openings 30 located alongside and one behind the other, which take the form of sections pressed out in the direction of the appropriate bottom 14,16 and open only in the direction of conveying of the goods for processing (direction of arrow A). The through holes 30 are not therefore produced simply by punching through but by pressing out similar to the procedure with a grater. The through holes are preferably small and positioned very close together. FIGS. 3 and 4 illustrate a front or side view of the processing surfaces 18,20 with FIG. 4 in particular showing in longitudinal section a toothed shape of the individual pressed-out sections 32 which are open in the direction of conveying (Arrow A).

In the embodiment shown, the processing surfaces 18,20 are executed over their entire surface in the manner described. It is however also possible in the context of the invention to execute only partial areas in this way, whilst other areas are left uncontoured or display projections and rebounds off other configurations, for example a cube, pyramid, hemisphere or quarter-sphere. Likewise that surface of the processing surface 18,20 facing the relevant bottom 14,16 can also be executed with pins projecting downwards, similar to a brush. Here it is also particularly advantageous if the projections and rebounds displayed a overall height (depth) i.e. if they project downwards more or less in the direction of the appropriate bottom 14,16.

Shoulders **34*a,b* are welded vertically to the ends of the side walls 22,24. These shoulders are parallel to and at a distance from an appropriate foundation 36*a,b*. Between each shoulder 34*a,b* and the appropriate foundation 36*a,b* a pair of pressure springs 38*a,b* is located, whereby the appropriate pressure springs rest against the shoulders 34*a,b* or the foundation 36*a,b* under stress. For the mechanical support of the shoulders 34*a,b*, appropriate angles 40*a,b* are welded to the side walls 22,24**.

As is particularly clear from FIG. 2, the distance between the bottom 16 and the accompanying processing surface 20 is somewhat smaller than the distance between bottom 14 and the processing surface 18. The corresponding distances are determined in each case by the goods for processing as described above.

The distance between the processing surface 20 of processing line 12 and the bottom 14 of the processing line 10 located above it, is a multiple of the last-named distance between the components 14,18.

The bottoms 14,16 can be shaped in a manner similar to the processing surfaces 18,20, and in particular profiles can be provided on the bottoms 14,16, also.

FIG. 1*a* shows that the processing lines 10,12 or the accompanying components are provided with a gradient, namely from one infeed area 44 to one discharge area 46. The infeed area 44 displays an arrangement 48 which essentially takes the form of a shaft and is shown in magnified diagrammatic representation in FIG. 1*b*.

At its upper end the arrangement displays a charging funnel 50, adjoined by two sliding sections 52,54 at an angle of $\alpha$ to one another and with a gradient running down to the bottom 14. These sections become lower sliding sections 60,62 via stages 56,58. The sliding sections 60,62 proceed from stages 56 or 58 in a shape which extends trapezoidally in top view. Vertical plates 64 located on the sliding sections 60,62 expand in a stellar configuration at a distance from one another, their distance from one another in the area of stage 58 being smaller than at the opposite end. The bottom of the sliding sections 60,62 has the configuration of the bottom of a sieve 66. The front end of the sieve bottom 66 in the direction of conveying A passes over into the start of the bottom 14, and is located slightly above it.

Below the sieve bottom 66, the device 48 continues with a freefall section 68, which as illustrated in FIG. 1*b* is also divided by vertical plates 40 into chambers 72, extending vertically.

The bottom of the free-fall section 68 is shaped like a sieve bottom 74 in its turn with a smaller mesh width than the sieve bottom 66. The front edge of the sieve bottom 74 in the direction of conveying A is located somewhat above the bottom 16, which connects directly with the sieve bottom 74. Beneath the sieve bottom 74 there is a funnel-shaped projection 76.

Beneath the processing line 12 two further collecting funnels 78,80 are located one behind the other in the direction of conveying A, which funnels face a shared conveyor belt (not shown), along with the projection 76.

On the top side the processing line 10 is closed by means of two cover sheets 82,84 located one behind the other in an arched configuration in the direction of conveying A, the top side of each sheet displaying a suction device 86.

In the offtake area 46 two channels 88,90 angled downwards adjoin the processing lines 10 or 12, which face a conveyor belt, again not shown.

Somewhat in the middle of the processing lines 10,12 (viewed in the direction of conveying A) a shaft 92 traverses the side walls 22,24 in which it is mounted rotatably. At each of the shaft ends at the outside there is an unbalanced disc of adjustable size. Each unbalanced disc 94 is connected rigidly to the shaft 92. At the free end associated with the side wall 24, a further disc 96 is mounted on the shaft 92 which disc serves to take up a belt (not shown), conducted at a distance from disc 96 around a further disc, mounted on a motor shaft. The belt drive thus serves to rotate the shaft 92.

In place of the unbalanced drive described an eccentric drive can for example also be provided. The invention also provides for the possibility of placing a vibration device directly against one or both side walls 22,24 and/or the bottoms 14,16 or processing surfaces 18,20.

FIG. 6 gives an example of a flow-sheet for the mechanical processing of burnt lime using a plant according to the invention.

At the outset it was indicated that in the mechanical processing of steel works lime the target is a product with the minimum possible sulphur content. The plant according to the invention is designed to serve this purpose, and is designed to help remove the surface area of the lumped lime which has a particularly high concentration of sulphur.

As shown in FIG. 6 the stream of material first passes through a sieve, which separates out the granular fraction larger than 50 mm. It has been found that with these lumps the ratio of sulphur-charged surface to the total volume is relatively small, so that viewed in terms of the overall mass, the lumps have a sulphur content within admissible limits results and this material in the embodiment illustrated does not need to be mechanically desulphurised.

The remaining stream of material (less than 50 mm) passes through the desulphurisation plant according to the invention. The material also passes via the receiving funnel 50 to the slides 52, 54 and divides into two streams of equal size. On account of the gradient of the slide sections (chutes) 52,54, the material slides further down. There it reaches slide sections 60,62, where each stream of material is further divided by the plates 64 into five component streams. On account of the geometrical arrangement of the plates 64 the component streams are conducted so to be spread over the entire width of the plant on transfer to the bottom 14.

Sieving also occurs along path sections 60,62 whereby material smaller than 30 mm passes through the sieve bottom 66 and the free-fall section 68 to sieve bottom 74, where further sieving takes place and only material smaller than 10 mm is able to pass through. This material is conveyed via the projection 76 without mechanical surface processing to a sieve, as will be described in greater detail below.

The two granular fractions 30 to 50 mm or 10 to 30 mm then pass from sieve surfaces 66,74 either on account of their oblique angle and/or because of vibration devices connected to the associated bottoms 14 or 16. With a mechanical connection to the side walls 22,24 the said arrangement 48 can also be caused to oscillate by the unbalanced drive 92,94.

As soon as the individual lump of lime has reached the bottom 14 or 16 mechanical removal of the surface commences.

On account of the surrounding imbalance 94 ( here at a speed of 750 rpm ) a short-wave oscillation movement is transferred via the rigid side walls 22,24 whereby the height of the corresponding oscillation amplitude is adjustable for example by the design and arrangement of the unbalanced mass 94. In the embodiment illustrated, an oscillation amplitude of 20 mm is selected. The forces transferred by the mass 94 are taken up by the pairs of pressure springs 38*a,b*. The device as a whole is moved along an approximately circular track, with direction of movement as indicated by the arrow B.

It has proved to be particularly advantageous to operate the plant in "constant flow", i.e to allow the unbalanced mass to circulate in the direction in which the goods are conveyed (direction of arrow A).

It is quite clear that on a first upward movement of the unbalanced mass 94 the goods resting loose on bottom 14 or 16 are initially entrained while resting on the respective bottom 14 or 16.

Subsequently on downward (return) movement of the unbalanced mass 94, the parts of the device themselves will be brought down again on account of the rigid connection between them. The lumps previously resting on the bottoms 14,16 have however, on upward movement, been accelerated to such an extent that they become detached from the associated bottom 14,16 and are hurled against the corresponding processing surface 18,20, whence they drop back to the bottom 14 or 16. Depending among other things on the mass of the individual parts, their surface structure, their angle of collision and return vis a vis the processing surface 18,20 and the oscillation amplitude set on the drive side, the lumps of lime are hurled to and fro in rapid succession between the bottom 14 or 16 and the associated processing surfaces 18 or 20. Here it is important that, on the basis of the stated parameter, the individual lump of lime is moved to and fro each time with a somewhat different orientation between bottom and associated processing surface additionally depends on the relevant deformation of the elastic oscillating bottom 14 or 16. However this also causes the individual lumps of lime to encounter surfaces at varying angles, so that they are returned at a new angle.

The constant hurling of the solid parts against the processing surface 18 or 20, and also their collision against the corresponding bottoms 14 or 16 causes surface abrasion, so that the outer, highly sulphurous skin is gradually removed. The fine material abraded can be removed to outside the plant via openings in the bottom 14 or 16. Here the fine material from the processing line 10 will first fall through the space between the processing lines 10,12, and is conducted via the openings in the processing surface 20 and the openings in the associated bottom 16 to the collecting funnels 78,80.

On account of the angle of the device overall, or especially of the bottom 14,16, but also intensified by the rotating direction of the unbalanced drive, the individual lumps of material are "dandling" between floors 14,16 and the associated processing surface 18,20 from the infeed area 44 to the discharge area 46, whereby the high rate of impulses causes a multiplicity of surface contacts between material and treatment surface 18,20 or bottom 14,16.

The selection of the length of the plant or the impulse rate set, and the remaining parameters referred to above, are set according to the lumped goods for processing. Likewise in the individual case the geometrical shape of the tools is set on the under-side of the processing surfaces 18,20 or as provided for in an alternative embodiment on the corresponding bottoms 14 or 16. In the embodiment the processing surfaces 18,20 are the same shape over the entire conveying section, i.e. similar to a grater with projections pressed out downwards and open in the direction of arrow A. Material is thus abraded through a lengthwise strip of the individual granule over the pressed out surface section, whereby a "softer" abrasion of the material is achieved than where the individual parts are hurled against the openings 30 of the pressed out sections 32, as would be possible if the direction of rotation of the unbalanced mass 94 were reversed.

It has been found that with processing as represented in the embodiment a very small surface of the individual lumps of lime is achieved, which indicates that the processing is particularly gentle.

In particular the surface areas of cavities on the surface of a lump of lime are also abraded in an almost identical manner and to an almost identical depth, since on account of the movement of material according to the invention, abrasion knobs, like the sections pressed out 32, can also find their way into such cavities.

The fine material abraded is withdrawn via the collecting funnels 78,80 and conveyed to the same sieve into which the fine stream drawn off at the bottom of the infeed area is also conveyed.

The mechanically conveyed coarse granules (granular fraction 10 to 15 mm) find their way via the channels 88,90 out of the plant for instance into a silo (not shown). A component stream of granular fraction 10 to 50 mm also runs into this, and is drawn off at the end of a roll type crusher plant into which the originally branched oversized granules (larger than 50 mm) are conducted.

The fine material (smaller than 10 mm), which is withdrawn from the desulphurisation plant, finds its way along with the fine material deposited at the end of the roll type crusher into a sieve plant, where it is divided into further granular fractions, for example 3 to 10 mm and smaller than 3 mm before being bunkered or decanted elsewhere. An example serves to illustrate the mode of operation of the plant according to the invention, as depicted in the drawing.

The initial material available is a burnt lime with S03 content of 0.13% by weight in granular fraction 10 to 50 mm. The material was charged in the plant according to the drawing, and passed through it in constant current. Along the processing section about 15% by weight of material was removed i.e. 15% by weight of the charged quantitive flow was withdrawn via the discharge arrangements 76, 78, 80. The remaining 85% by weight, in granular size 10 to 50 mm then displayed an S03 content of only 0.05% by weight, corresponding to a reduction of about 60%. With very small losses of material it was thus possible to achieve a drastic reduction in the S03 content.

Countless developments and alternatives are possible, in the context of the invention. Instead of conducting the stream of material along processing section, as explained above by means of the embodiment, the goods can also be placed on a defined (horizontal) surface, and hurled against a processing surface located above this, whereby the extent of surface removal can be controlled by setting a specific period of time and the adjusting impulse applied.

If a particularly mild surface removal is desired, it can be sufficient to construct the processing surface without profiles or simply to roughen it, or again to press the sheet outwards (away from the bottom), so that only negative irregularities in the processing surface are formed for the material conducted against it.

We claim:

1. Process for mechanical surface removal of lumped lime having a sulphur containing layer, wherein the lumped lime is treated by, starting from a bottom, accelerating the lumped lime by a mechanical impulse and projecting the lumped lime against a processing surface, returning the lumped lime thence to the bottom, and continuing to treat the lumped lime along a conveying path for a predeterminable period of time between the bottom and the processing surface, with the processing surface provided at least over partial sections thereof with profiles, until a desired surface removal is achieved.

2. Process according to claim 1, characterized in that the lumped lime resting on the bottom is exposed to mechanical impulses applied in rapid succession via a vibration means bearing on the bottom.

3. Process according to claim 2, characterized in that the acceleration applied to the lumped lime by an impulse is so high that on reaching the processing surface it amounts to many times the acceleration due to gravity.

4. Process according to claim 2, characterized in that the lumped lime acceleration is 3 to 6 times the acceleration due to gravity.

5. Process according to claim 1, characterized in that the lumped lime is conveyed along the conveying path for a predeterminable period of time in its movements between bottom and processing surface, at varying angles to the conveying path.

6. Process according to claim 1, characterized in that the lumped lime is conveyed over a deformable bottom against a deformable processing surface.

7. Process according to claim 6, characterized in that the deformable bottom and the deformable processing surface are elastic.

8. Process according to claim 1, characterized in that the lumped lime is moved along a gradient.

9. Process according to claim 1, characterized in that the lumped lime is conveyed in a rotating manner between the bottom and the processing surface.

10. Process according to claim 1, characterized in that the lumped lime is divided into streams of varying granular fraction and these are processed separately from another.

11. Process according to claim 1, characterized in that the lumped lime, before being introduced into the space between the bottom and the processing surface, is brought into contact with water, causing hydration on the surface.

12. Process according to claim 1, characterized in that the lumped lime resting on the bottom is exposed to mechanical impulses applied in rapid succession and the impulses are preferably applied to the goods via a vibration means bearing on the processing surface.

13. Device for mechanical surface abrasion of lumped lime with at least one conveying bottom and a processing surface located at a distance therefrom, which is provided at least over partial sections with profiles as well as an arrangement for applying a mechanical impulse to the lumped lime to be processed wherein the conveying bottom is deformable in order to increase the influence of the mechanical impulse applied thereto.

14. Device according to claim 13, characterized in that the arrangement for applying the mechanical impulse to the lumped lime is arranged on the bottom.

15. Device according to claim 13, characterized in that the bottom is spring mounted.

16. Device according to claim 15, characterized in that the bottom is movable by a constrained agitator.

17. Device according to claim 16, the constrained agitator being a vibrator.

18. Device according to claim 16, characterized in that the constrained agitator is created by an unbalanced arrangement, mounted on and fixed to a shaft driven rotatable by a motor.

19. Device according to claim 13, characterized in that the bottom is movable along a rotating conveying track.

20. Device according to claim 13, characterized in that the bottom and the processing surface are movable asynchronously with one another.

21. Device according to claim 13, characterized in that the angle of inclination to the horizontal line of the bottom may be adjusted.

22. Device according to claim 12, characterized in that the bottom is provided at least over partial sections with profiles.

23. Device according to claim 22, characterized in that the profiles consist of projections and recesses.

24. Device according to claim 23, characterized in that the projections and recesses take the form of a brush.

25. Device according to claim 22, characterized in that the processing surface is divided into zones of different profiles.

26. Device according to claim 13, characterized in that the distance between bottom and corresponding processing surface is less than two times and more than the maximum diameter of the lumped lime charged.

27. Device according to claim 13, characterized in that the bottom is a rubber blanket.

28. Device according to claim 13, characterized in that on the infeed side end, an arrangement is adapted to divide the lumped lime over the entire width of the bottom.

29. Device according to claim 13, characterized in that at least one receiving arrangement is provided beneath the bottom.

30. Device according to claim 13, characterized by a sound- and dustproof casing and at least one suction arrangement connected thereto.

31. Device according to claim 13, characterized in that the conveying bottom is non-deformable and the processing surface is deformable in order to increase the influence of the mechanical impulse applied thereto.

32. Device according to claim 13, characterized in that both the conveying bottom and the processing surface are deformable in order to increase the influence of the mechanical impulse applied thereto.

33. Device according to claim 13, characterized in that the arrangement for applying the mechanical impulse to the lumped lime is arranged on the corresponding processing surface.

34. Device according to claim 13, characterized in that the arrangement for applying the mechanical impulse to the lumped lime is arranged on the elements connecting the bottom with the corresponding processing surface.

35. Device according to claim 13, characterized in that the processing surface is spring mounted.

36. Device according to claim 13, characterized in that the processing surface is movable along a rotating conveying track.

37. Device according to claim 13, characterized in that the angle of inclination to the horizontal line of the processing surface may be adjusted.

38. Device according to claim 13, characterized in that the processing surface is a rubber blanket.

39. A process for the mechanical removal of a sulphur containing layer from lumped lime, comprising accelerating the lumped lime by a mechanical impulse from a bottom position and projecting the lumped lime against a processing surface having profiles provided over at least partial sections thereof, allowing the lumped lime to fall and return to the bottom position after contact with the processing surface, and continuing the acceleration of the lumped lime against the processing surface and subsequent return of the lumped lime to the bottom position along a conveying path for a predeterminable period of time until a desired amount of the sulphur containing layer of the lumped lime is removed.

40. A device for the mechanical removal of a sulphur containing layer from lumped lime, comprising means for conveying the lumped lime, a processing surface located at a distance from the conveying means, profiles provided at least over partial sections of the processing surface, means for applying a mechanical impulse to the lumped lime to be processed to project the lumped lime against the processing surface and against the profiles in the processing surface, whereby the lumped lime falls back onto the conveying means and is continually projected by the impulse means against the processing surface and the profiles on the processing surface until a desired amount of the sulphur containing layer is removed from the lumped lime, the conveying means and processing surface being constructed of an elastic material, the mechanical impulse means arranged to apply the mechanical impulse to the conveying means and the processing surface, the conveying means and processing surface being spring mounted and movable by a constraining agitator, the conveying means and processing surface being movable along a rotating track, the conveying means and the processing surface movable asynchronously with one another, the angle of inclination to the horizontal line of the conveying means and the processing surface being adjustable, the conveying means being provided with profiles at least over partial sections thereof, the profiles consisting of projections and recesses, the distance between the conveying means and the processing surface being less than two times, but greater than, the maximum diameter of the charged lumped lime, the infeed side being provided with an arrangement adapted to divide the lumped lime over the entire width of the conveying means, at least one receiving arrangement provided beneath the conveying means, and a sound and dust proof casing having at least one suction arrangement being connected to the device.

* * * * *